US008408756B2

(12) United States Patent
Schwarz et al.

(10) Patent No.: US 8,408,756 B2
(45) Date of Patent: Apr. 2, 2013

(54) LIGHT HAVING A HOUSING PART AND A COVER

(75) Inventors: Gerhard Schwarz, Schoenbrunn-Allemuehl (DE); Reiner Naumann, Mannheim (DE)

(73) Assignee: Cooper Crouse-Hinds GmbH, Soest (DE)

( * ) Notice: Subject to any disclaimer, the term of this patent is extended or adjusted under 35 U.S.C. 154(b) by 776 days.

(21) Appl. No.: 12/520,232

(22) PCT Filed: May 8, 2007

(86) PCT No.: PCT/EP2007/004056

§ 371 (c)(1),
(2), (4) Date: Dec. 14, 2009

(87) PCT Pub. No.: WO2008/083722

PCT Pub. Date: Jul. 17, 2008

(65) Prior Publication Data

US 2010/0103684 A1 Apr. 29, 2010

(30) Foreign Application Priority Data

Dec. 21, 2006 (DE) ..... 10 2006 060 782

(51) Int. Cl.
*F21V 33/00* (2006.01)

(52) U.S. Cl. ..... 362/363; 362/267; 362/374

(58) Field of Classification Search ..... 362/363, 362/267, 374
See application file for complete search history.

(56) References Cited

U.S. PATENT DOCUMENTS

| | | | | |
|---|---|---|---|---|
| 2,702,849 | A * | 2/1955 | Bissell | 362/267 |
| 5,379,195 | A | 1/1995 | Epstein | |
| 5,911,499 | A | 6/1999 | Stafford et al. | |

FOREIGN PATENT DOCUMENTS

| | | |
|---|---|---|
| DE | 1 609 038 | 6/1950 |
| DE | 195 14 776 | 2/1996 |
| DE | 200 10 707 | 9/2000 |
| DE | 20010707 U1 | 10/2000 |
| DE | 202 04 003 | 7/2003 |
| GB | 2148113 | 5/1985 |
| RU | 2 269 716 | 2/2006 |
| RU | 2269716 C1 | 2/2006 |
| RU | 2 276 307 | 5/2006 |

OTHER PUBLICATIONS

International Search Report for International Application No. PCT/EP2007/004056, mailed Jul. 26, 2007.
German Search Report for German Application No. 10 2006 060 782.1, mailed Sep. 4, 2007.

* cited by examiner

*Primary Examiner* — Joseph L Williams
(74) *Attorney, Agent, or Firm* — Fish & Richardson P.C.

(57) ABSTRACT

A light includes a housing part and a translucent cover connected to the housing part, in a pressure-tight manner, by a screw-on ring. A flame-extinguishing gap is formed between the housing part and the cover. The flame-extinguishing gap is formed directly between a surface of the cover, and a surface of the housing part, and the screw-on ring covers the flame-extinguishing gap at the gap end pointing to the outer side of the light.

20 Claims, 1 Drawing Sheet

LIGHT HAVING A HOUSING PART AND A COVER

CROSS-REFERENCE TO RELATED APPLICATIONS

This application is a U.S. National Stage application under 35 U.S.C. §371 of International Application Number PCT/EP2007/004056, filed May 8, 2007, which claims priority from German Application No. 10 2006 060 782.1, filed Dec. 21, 2006.

TECHNICAL FIELD

The present invention relates to a light including at least one housing part and a translucent cover which is connected to the housing part in a pressure-tight manner by a screw-on ring, a flame-extinguishing gap being formed between the housing part and the cover. Such lights can be used as spotlights, floodlights, pendant lamps or the like also in areas where explosion protection requirements must be fulfilled. For fulfilling these requirements, the respective flame-extinguishing gap has specific dimensions which, depending on the explosion protection in question, are predetermined by respective standards and the like.

BACKGROUND OF THE INVENTION

In the case of the lights known in practice, it has hitherto been necessary to connect the translucent cover to a metal ring or the like, so as to form the respective flame-extinguishing gap, said flame-extinguishing gap being then defined between this metal ring and the housing part. The metal ring is connected by an adhesive to the translucent cover consisting e.g. of glass, such as borosilicate glass or the like. This connection cannot, or only with difficulty, be released e.g. for the purpose of recycling the respective parts of the light.

It is the object of the present invention to improve a light of the type described at the beginning in such a way that an appropriate flame-extinguishing gap is formed in a simple, structural manner while simultaneously simplifying the assembly operation without negatively affecting the recyclability.

SUMMARY

This object is achieved by the features of claim 1.

According to the present invention, the flame-extinguishing gap is formed directly between a surface, in particular the outer surface of the cover, and a surface, in particular the inner surface of the housing part, and the screw-on ring covers the flame-extinguishing gap at the gap end pointing to the outer side of the light. An additional metal ring is therefore no longer necessary, nor is it necessary to connect the cover and the metal ring by a suitable adhesive. This makes recycling of such a light much easier.

The translucent cover can consist of the above-mentioned glass, in particular borosilicate glass, or of a translucent plastic material. Also the housing part may be of plastic material or of metal.

The fact that the gap end is covered by the screw-on ring improves the electric strength of the light still further.

As regards the housing part and the cover, the light can be configured such that it is essentially rotationally symmetric with respect to a vertical longitudinal axis. Other forms are imaginable as well, e.g. angular, in particular square and rectangular cross-sections for the light or additional means for attaching the light to a wall, a ceiling or electric equipment.

It is possible to form the respective flame-extinguishing gap generally between the outer surface of the cover and a complementary inner surface of the housing part, the cover being normally inserted at least partially into the housing part with a lower end thereof. A simplified mode of forming the flame-extinguishing gap can be seen in an embodiment in which a lower free end section of the cover is inserted into an at least upwardly open reception of the housing part, the flame-extinguishing gap being then formed between this lower end section and the reception. The flame-extinguishing gap is thus essentially formed between the cover end facing the housing part and the housing part end facing the cover.

A simple possibility of associating the respective flame-extinguishing-gap-forming surfaces with one another is obtained when the lower end section is implemented as a radially outwardly enlarged edge flange having at least a flat edge exterior. This flat edge exterior forms a boundary for the flame-extinguishing gap.

In order to form a boundary in a similar way on the side of the reception, said reception can be implemented as a reception step, which enlarges the housing interior radially outwards and which is provided with a substantially flat step exterior. The flame-extinguishing gap is delimited by the flat edge exterior of the edge flange and by the flat step exterior of the reception step.

The respective dimensions of the flame-extinguishing gap can, in particular, be easily determined when the heights of the edge flange and of the reception step are essentially identical.

The whole length of the gap thus results essentially from the height of the edge flange and of the reception step and from the analogous height of the edge exterior and of the step exterior, respectively.

In order to provide sufficient space in the interior of the light, and in particular in the area of the flame-extinguishing gap, the width of the reception step can be essentially identical to the wall thickness of the edge flange. This guarantees that the edge flange will not project into the interior of the light, but that a substantially flat surface without abrupt changes in diameter or the like will be obtained also in this area.

The screw-on ring is screwed onto the housing part and holds the cover relative to the housing part in its screwed-on position. In order to facilitate screwing on, the housing part can have, at least in the area of the reception step, an external thread for screwing on the screw-on ring.

For sealing off the light interior with respect to the light exterior at least partially, in addition to the formation of the flame-extinguishing gap, at least one sealing element can be arranged at least between the free lower end of the edge flange and the step bottom of the reception step. This sealing element can be implemented as a sealing ring or the like. Depending on the wall thickness of the edge flange, two or more of these sealing elements may also be arranged side by side.

For easily fixing the cover within the housing part by screwing on the screw-on ring, the edge flange can be provided with a radially inwardly directed step that is arranged on the upper end located opposite the lower end of said edge flange. This step can be used as an abutment for the screw-on ring and, consequently, it can be used for fixing the cover relative to the housing part.

In order to easily achieve suitable fixing, the screw-on ring can have a cross-section having an inverted L-shape, a substantially vertical first L-leg being implemented as a screw-on leg and a substantially horizontal second L-leg being implemented as a holding leg. The screw-on leg is screwed on by a suitable external thread on the outer surface of the housing part, and, when the screw-on leg has reached a certain position, the holding leg will abut on the flange step of the edge flange and thus fix the cover within the housing part.

In order to allow the screw-on ring to be formed integrally from one material, it is possible to provide the screw-on leg and the holding leg with substantially the same material thicknesses.

For possibly centering the cover relative to the housing part, when the screw-on ring is rotated relative to the cover, and for simultaneously preventing, to a very large extent, the outer side of the cover from getting damaged, the holding leg can be provided with an abutting nose on the free leg end facing the cover. This abutting nose may also consist of a material that is softer than the rest of the holding leg.

For avoiding a direct contact between the holding leg and the flange step, at least the holding leg and the flange step can have provided between them a flexible bearing element at least at some points. This flexible bearing element is partially compressed, when the screw-on ring is being screwed on, and serves to flexibly support the cover in the housing part.

The bearing element can be implemented as a bearing ring which extends circumferentially around the cover in the area of the flange step.

In order to avoid, as far as possible, any projections on the outer side of the light in the area of the screw-on ring and in order to thus minimize possible risks of injury, the housing part can have, in the area of the external thread, a screw-on step which is offset radially inwards. The respective external thread is arranged in the area of this screw-on step, and the screw-on step serves to accommodate, at least partially, the screw-on leg within the contour of the light.

This accommodation of the screw-on leg is improved by dimensioning the width of the screw-on step possibly such that it is substantially equal to the wall thickness of the screw-on leg.

In order to prevent the respective dimensions of the flame-extinguishing gap from changing inadvertently or automatically, at least one locking element can be arranged between the screw-on ring and the housing part and/or the cover. This locking element prevents a loosening of the screw-on ring and thus a change in the dimensions of the flame-extinguishing gap. The screw-on ring cannot be loosened until the locking element has been removed or at least loosened.

A simple embodiment of such a locking element can be a locking element which is implemented as a locking screw which can be displaced by screwing it through the holding leg.

This locking screw can be screwed up to and into the housing part or the cover. Normally, it will, however, suffice when, at the retaining position of the locking screw, the screwed-in lower end of the locking screw abuts on a free end face of the housing part, said free end face being arranged between the reception step and the screw-on step. Due to the flexibility of the holding leg, a friction force will be generated between the lower end of the screw and the end face of the housing part, when the locking screw has reached a sufficiently advanced position; this friction force will reliably prevent an inadvertent or automatic rotational displacement of the screw-on ring. Such rotational displacement of the screw-on ring will only be easily possible when the locking screw has been loosened.

DESCRIPTION OF THE DRAWINGS

In the following, an advantageous embodiment of the present invention will be explained in detail on the basis of the figures enclosed, in which.

DETAILED DESCRIPTION

Figure 1:
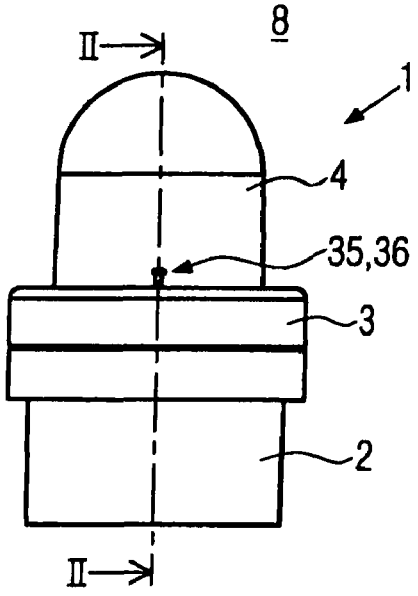
FIG. 1 shows a side view of a light according to the present invention.

FIG. 1 shows a side view of an embodiment of a light 1 which is essentially rotationally symmetric. This light is provided with a translucent cover 4 includes glass, plastic material or the like. The cover 4 is fixed to a lower housing part 2, which also includes plastic material or metal, by a screw-on ring 3. Additional devices for arranging the light on a wall, a ceiling or electric equipment, and electric supply lines are not shown for the sake of simplicity.

The cover 4 substantially comprises a cylindrical lower part and a hemispherical upper part, which define approximately a dome-shaped cover.

In FIG. 1 as well as in the following figures respective identical parts are identified by identical reference numerals and some of these parts are only referred to in combination with one figure.

Figure 2:
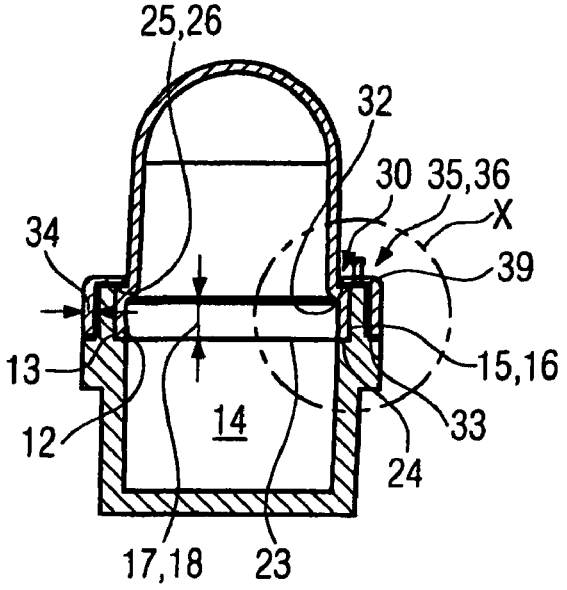
FIG. 2 shows a section along line II-II of the light according to FIG. 1.
Figure 3:
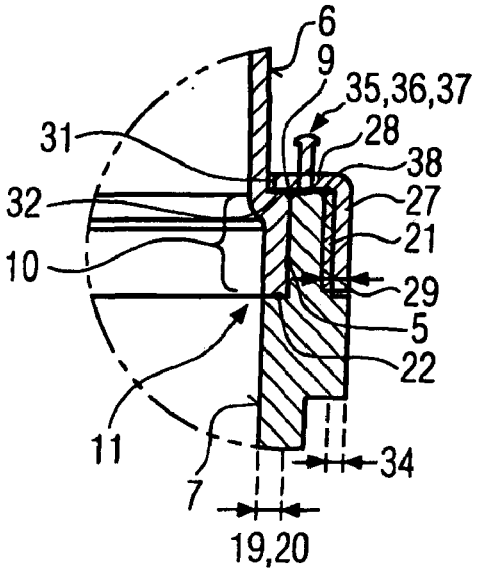
FIG. 3 shows an enlarged representation of detail "X" of FIG. 2.

FIG. 2 corresponds to a section along II-II of FIG. 1. The cover 4 includes a lower end section 10, cf. also FIG. 3 which corresponds to a magnification of detail "X" of FIG. 2. This lower end section 10 is defined by a radially enlarged edge flange 12. The edge flange 12 is arranged in a reception 11 of the housing part 2. This reception 11 is implemented as a reception step 15 which enlarges the housing interior 14 radially outwards. In the area of the reception step 15, the edge flange 12 is provided with an edge exterior 13 delimiting, together with a step exterior 16 of the reception step 15, a flame-extinguishing gap 5 in the radial direction. The flame-extinguishing gap 5 extends down to the step bottom 24 and, on the opposite side, with its gap end 9 up to an upper end 25 of the edge flange 12. The edge flange 12 is provided with a flange step 26 at this upper end 25, said flange step 26 having a substantially horizontal, flat surface. At the fixed position of the cover 4, this flat surface is arranged flush with a free end face 39 of the housing part 2, cf. FIGS. 2 and 3.

The reception 11 or reception step 15 is implemented with a height 18 corresponding essentially to a height 17 of the edge flange 12.

A sealing element 22 in the form of an O-ring or the like is arranged between the step bottom 24 and the free lower end 23 of the edge flange 12.

A respective width 19 of the reception step 15 corresponds to a wall thickness 20 of the edge flange 12 so that the surface on the inner side of said edge flange 12 is arranged flush with the inner surface or inner side 7 of the housing part 2.

For screwing on the screw-on ring 3, the housing part 2 has an external thread 21 on the outer side thereof, said external thread 21 being provided in the area of the reception step 15. The external thread 21 is formed in the vertical direction in the area of a radially inwards extending screw-on step 33 of the housing part 2. The screw-on ring 3 has an L-shaped cross-section comprising a first substantially vertical leg as a screw-on leg 27 and a second substantially horizontal leg as a holding leg 28. The screw-on leg 27 is screwed onto the external thread 21, and, when the screw-on leg 27 has reached a sufficiently advanced position, the holding leg 28 will apply pressure from above onto the free end face 39 and also onto the flange step 26. The flange step 26 and the holding leg 28 have additionally provided between them a flexible bearing element 32 through which a direct contact between the holding leg 28 and the flange step 26, i.e. the edge flange 12, is avoided.

For avoiding also a direct contact between the free leg end 30 of the holding leg 28 and the outer side of the cover 4, the holding leg 28 is provided with an abutting nose 31 on this free leg end 30. This abutting nose 31 may consist of a softer material.

The screw-on step 33 has a width 34 which corresponds essentially to the wall thickness 29 of the screw-on leg 27. Hence, said screw-on leg 27 is accommodated by said screw-on step 33 in such a way that the outer surfaces thereof are substantially flush with one another.

In order to secure the screw-on ring 3 at the position in question, a locking screw 36 can be screwed into the holding leg 28 as a locking element 35. At a retaining position 37 of the locking screw 36, the lower end 38 of the locking screw 36 abuts on the free end face 39 of the housing part 2 between the reception step 15 and the screw-on step 33.

It should be pointed out once more that the respective flame-extinguishing gap 5 is defined directly between the outer surface 6, i.e. the edge exterior 13 of the edge flange 12 and the step exterior 16 of the reception step 15. Additional means for forming this flame-extinguishing gap, such as a metal ring or the like that has to be connected to the outer side of the cover 4 by means of an adhesive, are not necessary. The respective flame-extinguishing gap 5 is simultaneously covered by the holding leg 28 at the upper gap end 9 towards the exterior 8 of the light 1, cf. FIG. 3.

The respective parts of said light can easily be recycled, since adhesive joints or the like do not exist, and since all the parts can easily be separated from one another and sorted according to their material properties.

The light can also be assembled more easily, since, after all, it only has to be stuck and screwed together, without any necessity of using an adhesive.

The invention claimed is:

1. A light comprising:

a housing part; and a translucent cover connected to the housing part, in a pressure-tight manner, by a screw-on ring, a flame-extinguishing gap being formed between the housing part and the cover, wherein the flame-extinguishing gap is formed directly between a surface of the cover and a surface of the housing part, and the screw-on ring covers the flame-extinguishing gap at a gap end pointing to an outer side of the light.

2. The light of claim 1, wherein a lower free end section of the cover is inserted into an upwardly open reception of the housing part, and the flame-extinguishing gap is formed between the lower end section and the reception.

3. The light of claim 2, wherein the lower free end section is a radially outwardly enlarged edge flange having at least a flat edge exterior.

4. The light of claim 3, wherein the reception is a reception step that enlarges a housing interior radially outwards and has a substantially flat step exterior.

5. The light of claim 4, wherein a height of the edge flange and a height of the reception step are essentially identical.

6. The light of claim 4, wherein a width of the reception step is essentially identical to a wall thickness of the edge flange.

7. The light of claim 4, wherein the housing part has, at least in the area of the reception step, an external thread for screwing on the screw-on ring.

8. The light of claim 4, wherein a sealing element is arranged at least between a free lower end of the edge flange and a step bottom of the reception step.

9. The light of claim 4, wherein the edge flange includes a radially inwardly directed step arranged on a upper end located opposite the lower end of the edge flange.

10. The light of claim 1, wherein the screw-on ring has a cross-section having an inverted L-shape, a substantially vertical first L-leg being implemented as a screw-on leg and a substantially horizontal second L-leg being implemented as a holding leg.

11. The light of claim 10, wherein a wall thickness of the screw-on leg and a wall thickness of the holding leg are substantially the same.

12. The light of claim 10, wherein the holding leg includes an abutting nose on a free leg end facing the cover.

13. The light of claim 10, wherein a flexible bearing element is between the holding leg and a flange step.

14. The light of claim 7, wherein in the area of the external thread, the housing part includes a screw-on step that is offset radially inwards.

15. The light of claim 14, wherein a width of the screw-on step is substantially equal to a wall thickness of a screw-on leg.

16. The light of claim 1, wherein a locking element is arranged between the screw-on ring and the housing part.

17. The light of claim 16, wherein the locking element is a locking screw configured to be displaced by screwing the locking screw through a holding leg.

18. The light of claim 17, wherein when in a retaining position, a screwed-in lower end of the locking screw abuts on a free end face of the housing part, the free end face being arranged between a reception step and a screw-on step.

19. The light of claim 1, wherein the surface of the cover is an outer surface of the cover, and the surface of the housing is an inner surface of the housing.

20. The light of claim 1, wherein a locking element is arranged between the screw-on ring and the cover.

* * * * *